US009278739B2

(12) United States Patent
Salles

(10) Patent No.: US 9,278,739 B2
(45) Date of Patent: Mar. 8, 2016

(54) MODULAR FOIL

(71) Applicant: F.ONE, Perols (FR)

(72) Inventor: Raphael Salles, Vic-la-Gardiole (FR)

(73) Assignee: F. ONE, Perols (FR)

( * ) Notice: Subject to any disclaimer, the term of this patent is extended or adjusted under 35 U.S.C. 154(b) by 0 days.

(21) Appl. No.: 14/701,268

(22) Filed: Apr. 30, 2015

(65) Prior Publication Data

US 2015/0314837 A1 Nov. 5, 2015

(51) Int. Cl.
*B63B 1/24* (2006.01)
*B63B 35/79* (2006.01)
*B63B 35/71* (2006.01)

(52) U.S. Cl.
CPC ..... *B63B 35/7923* (2013.01); *B63B 1/242* (2013.01); *B63B 1/248* (2013.01); *B63B 2035/715* (2013.01)

(58) Field of Classification Search
USPC ..... 114/274
IPC ..... B63B 35/7923,1/242, 1/248
See application file for complete search history.

(56) References Cited

U.S. PATENT DOCUMENTS 5,975,464 A * 11/1999 Rutan ..... B64C 39/02 244/118.2
2002/0115363 A1 8/2002 Murphy
2005/0090166 A1* 4/2005 Woolley ..... B63B 1/248 441/65
2007/0218788 A1* 9/2007 Field ..... B63B 35/793 441/79
2015/0017850 A1* 1/2015 Modica ..... B63B 1/24 441/79
2015/0225040 A1* 8/2015 Geislinger ..... B63B 1/242 441/79

FOREIGN PATENT DOCUMENTS

DE 43 04 158 A1 8/1994
FR 3017363 A1 * 8/2015 ..... B63B 1/248

OTHER PUBLICATIONS www.youtube.com/watch?v=aihqiBahXsU "Hydrofoil: AFS-1 session ENG" video clip from Apr. 6, 2012.

* cited by examiner

*Primary Examiner* — Stephen Avila
(74) *Attorney, Agent, or Firm* — Andrew W. Chu; Craft Chu PLLC

(57) ABSTRACT

The modular foil includes a wing and a fuselage extending in a longitudinal direction and bearing the wing. The fuselage includes a central segment, a first segment bearing a first portion of the wing, and being removable from the central segment, and an assembling device to connect the central segment with the first segment in the longitudinal direction. The central segment and the first segment are connected end to end. The assembling device includes a pair formed by a male connector and a female connector cooperating through a specific interlocking. The male connector includes at least one outer inclined wall, complementary and cooperating with an internal inclined wall born by the female connector for an optimal interlocking between the central segment and the first segment. There is a locking device along the longitudinal axis of the fuselage ensuring locking in at least one direction of the longitudinal axis.

13 Claims, 3 Drawing Sheets

MODULAR FOIL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention falls within the field of water sports the practitioner of which uses a pulling force for his displacements, such as the muscle energy of a human being or the wind energy, or a vehicle or an engine, namely the so-called "sliding" sports, in particular using a watercraft or traction sail, preferably kitesurfing.

The present invention will find a preferred, but in no way restrictive, application for kite surfing, but may be suitable for wakeboarding, windsurfing and surfing, or even kayaking.

The invention specifically relates to a foil device intended to be fastened to and to extend under the lower side of a watercraft or a board for practicing such water sports.

2. Description of Related Art Including Information Disclosed Under 37 CFR 1.97 and 37 CFR 1.98

In a known way, a foil is derived from the Anglo-Saxon term "hydrofoil", hereinafter referred to as "foil". A foil is a wing that moves in and into contact with the water, the hydrodynamic profile of which transmits to its support a lift force orthogonal to the direction of displacement of the board.

Such a foil is typically provided with at least one pole extending vertically, fixed in a removable way at the level of its upper extremity to the lower side of the board and connected at the level of its lower extremity to a wing. The latter extends laterally, generally symmetrically on both sides of a fuselage, with respect to the plane of the pole, aligned with the longitudinal median plane of the board. The wing can be formed by a single element, but it is generally comprised of at least two separate portions, a front one and rear one, permitting to obtain lever arms and moments necessary for the longitudinal stability for pitching and side stability for rolling.

Most existing foils are formed either of a single block forming the pole and the fuselage, the wings being removable or a pole and a block constituting the fuselage and wings, the block is removable. Though this single-block embodiment provides this foil with a high mechanical strength, it raises a problem for its transportation and its storage. This single-block foil has bulky dimensions, making its transportation as well as its assembling and disassembling for securing to the board constraining and tiresome.

It has been devised to separate the different elements forming a foil, i.e. the pole, the fuselage and wing portions, and to fasten them in a removable way to each other. Thus, once they have been disassembled, the various elements have a smaller size, which facilitates their storage and their transportation.

However, a problem lies in the removable fastening of the elements to each other and the orientation of the implemented fastening means. Indeed, the front and rear portions of the wing are applied against the pole, at the level of the fuselage, reciprocally at the front and the rear of the latter, which then has with its fuselage an inverted T-shape in the median plane of the foil, i.e. the vertical plane. This fastening occurs by screwing, transversely with respect to the plane of each wing portion, from the top or the bottom of each portion. The fastening axis is then located in a vertical plane oriented orthogonally with respect to the direction of displacement of the foil and substantially according to the lifting forces applied by each portion of the foil being moved. As a result, these constraints are applied at the level of each screw, mechanically deforming this particular point of junction. These constraints lead to a deterioration of this fastening over time, which can cause their breakage and the tearing of the wing portions.

Furthermore, in the case of several screws, the operations of assembling and disassembling the wing portions of such a foil remain tiresome and must be carried out methodically and carefully, especially as regards the assembling, in order to ensure a good fastening and a good positioning of the elements with respect to each other, providing the desired hydrodynamic characteristics.

An example of such a foil is described through US 2005/0255764. As mentioned above, such a foil comprises a pole at the lower extremity of which extends a fuselage, the unit having an inverted T-shape. A front fuselage of the fuselage receives a front wing portion fastened by screwing from above, while a rear fuselage receives a rear wing portion fastened by screwing from below.

An existing solution consists of a dismountable foil including a pole to which is fastened a fuselage that comprises removable front and rear wings. The fuselage includes two extremities, in the form of a front and rear half-cylinder complementary of a front half-cylinder comprising a front wing portion and a rear half-cylinder comprising a rear wing portion, respectively. The fuselage also includes a rod ensuring a longitudinal locking of the fuselage with the front and rear wing portions by passing through each of these parts. The rod comprises at each of its front and rear extremities a nose of the fuselage. Thus, the rear nose of the fuselage is rigidly fastened to the rod and the front nose comprises a complementary inner threading of the front extremity of the rod including in turn an outer threading. As a result, the centering and clamping of the wings to the fuselage are performed in a single step, when locking the front nose of the fuselage cooperating with the threaded extremity of the rod. In addition, the semi-cylindrical assembling of the fuselage and front and rear wing portions raises problems of putting into production. Indeed, in order to achieve an optimal centering and blocking of the semi-cylindrical parts it is necessary to manually polish each complementary part, which represents an additional production cost and time. Furthermore, the assembling of such a foil has a mechanical weakness at the level of the holding of the different parts it is comprised of (fuselage, front and rear noses of the fuselage and the front and rear wing portion), namely in view of the side or vertical forces with respect to the vector of displacement of the foil. Indeed, the rod ensures a longitudinal locking of the parts of the foil, but is also the only force holding the foil assembled against the multidirectional stresses exerted by the water onto the foil depending on its displacement. Moreover, since the fuselage is fastened to the pole over almost its entire length (except for the front and rear noses) has the disadvantage, once it has been disassembled, of having a bulky T-shaped part raising problems of storage and transportation.

SUMMARY OF THE INVENTION

The objective of the present invention is to cope with the drawbacks of the prior art by providing a modular foil comprised of several removable elements assembled and secured to each other. First of all, one feature of the invention resides in that the elements, once they have been assembled, are locked along the longitudinal axis of the fuselage of the foil, namely substantially in the direction of displacement of the foil.

To this end, the present invention relates to a foil comprising a wing and a fuselage extending in a longitudinal direction and bearing the wing, the fuselage comprising:

a central segment;

a first segment bearing a first portion of the wing, and being removable from the central segment; and assembling means enabling to connect in the longitudinal direction the central segment with the first segment;

wherein, the central segment and the first segment are connected end to end by the assembling means, which comprising a pair formed by a male connector and a female connector cooperating through a specific interlocking, male and female connectors being located at a central segment extremity and at a first segment extremity;

wherein, the male connector comprises at least one outer inclined wall, which is complementary and adapted for cooperating with an internal inclined wall born by the female connector, outer inclined wall and internal inclined wall providing an optimal interlocking between the central segment and the first segment;

wherein, locking means, which extend along the longitudinal axis of the fuselage and ensure, in coopering with the connector male and the connector female, the locking in at least one direction of the longitudinal axis.

This longitudinal locking completely changes the mechanical strength of the fastening between the assembled segments of the fuselage forming the fuselage. Indeed, with a component of the locking force extending along the longitudinal axis of the fuselage, the torques generated by the wing during the displacements are passed differently, directly at the level of the interlocking and not at the level of the fastening itself.

In addition, according to another feature, the invention provides for improving the assembling between the abutting segments by providing an interlocking by means of male and female connectors having inclined walls intended to cooperate with each other by sliding, which provides an improved guiding and centering of the so assembled segments, limiting the backlash once they have been locked. The male and female connectors also permit optimal interlocking of the segments and form a code permitting to make sure that the segments are correctly positioned with respect to each other.

According to a peculiarity of the invention, the contact between the central segment and the first segment being only realized by the contact between the male connector and the female connector.

Moreover, according to further additional, non-restrictive features, the fuselage further comprises a second segment bearing a second portion of the wing, and being removable from the central segment, the fuselage further comprises assembling means enabling to connect in the longitudinal direction the central segment with the second segment;

wherein, the central segment and the second segment are connected end to end by the assembling means, which comprising a pair formed by a male connector and a female connector cooperating through a specific interlocking, male and female connectors being located at a central segment extremity and at a second segment extremity;

wherein, the male connector comprises at least one outer inclined wall, which is complementary and adapted for cooperating with an internal inclined wall born by the female connector, outer inclined wall and internal inclined wall providing an optimal interlocking between the central segment and the second segment;

wherein, locking means, which extend along the longitudinal axis of the fuselage and ensure, in coopering with the connector male and the connector female, the locking in at least one direction of the longitudinal axis.

According to particularity of the invention, the contact between the central segment and the second segment being only realized by the contact between the male connector and the female connector.

The two abutting ends of the first and second segments can include their respective male connector, while the first extremity and the opposite second extremity of the central segment may include the corresponding female connectors.

The locking means may comprise at least one rod extending at least partially along at least the first segment and cooperating in locking with the central segment.

The locking means may comprise at least one rod cooperating in insertion within a first recess provided for along the first segment from a free extremity of the first segment opposite its connecting extremity and to said connecting extremity of the first segment, the rod cooperating in locking at least through the first extremity of said central segment with another segment of said fuselage.

Said locking means may comprise a single rod cooperating in insertion within a first recess provided for along the first segment from a free extremity of the first segment opposite its connecting extremity and to said connecting extremity of the first segment from its first extremity to its second extremity, said rod cooperating in locking within the connecting extremity of said second segment.

The rod may have a distal end cooperating in abutment against the opposite free extremity of the first segment.

The rod may comprise at least one external extremity threading, so as to cooperate with a complementary internal threading provided for in the connecting extremity of the central segment or the second segment.

According to another feature of the invention, a slot with a diameter slightly larger than that of the rod is provided for in the center of each male and female connector, permitting the rod to pass through each connecting segment.

In addition, the assembling and the fastening are made more accurate, thereby preventing the positioning errors and the adjustments of the elements with respect to each other.

According to a particular embodiment of the invention, the male connector comprises two complementary inclined walls adapted so as to cooperate with two inclined walls provided for in the female connector.

Furthermore, in a preferred embodiment of the invention, the male connector comprises four complementary inclined walls adapted so as to cooperate with four inclined walls provided for at the level of the female connector.

Further features and advantages of the invention will become clear from the following detailed description of non-restrictive embodiments of the invention, with reference to the attached figures.

BRIEF DESCRIPTION OF THE DRAWINGS

FIG. 3 is a side schematic view of the embodiment of FIGS. 1 and 2, in the assembled position of the foil, showing by transparency the assembling of the various elements it is comprised of.

DETAILED DESCRIPTION OF THE DRAWINGS

Figure 1:
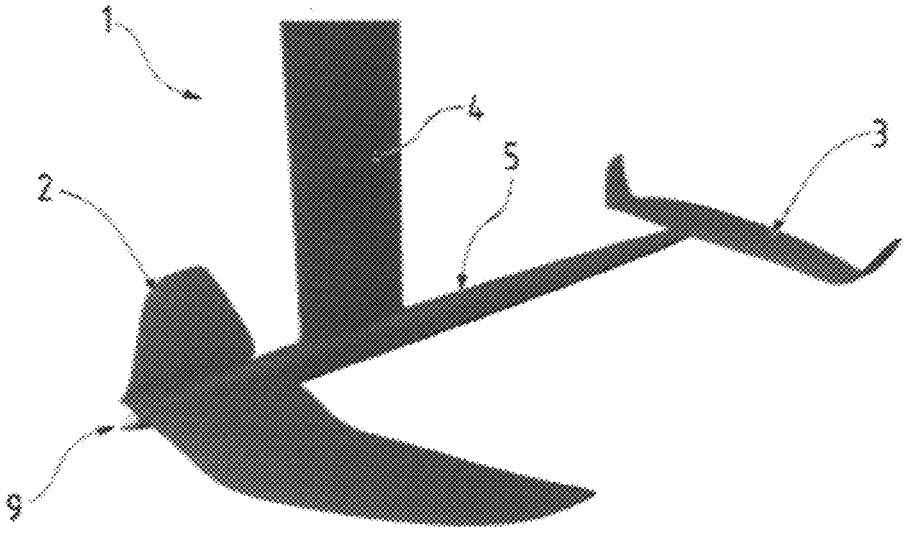
FIG. 1 represents a perspective view of an exemplary schematic embodiment of a foil device according to the invention, in the assembled position.

The present invention relates to a foil device 1.

Such a foil 1 comprises at least one wing, preferably, but not exclusively at least one front wing 2 and at least one rear wing 3. Each wing 2 and 3 may comprise several, preferably two, portions extending symmetrically on both sides, right and left with respect to the vertical median plane of the foil 1. Each wing 2 and 3 has an aerodynamic or hydrodynamic profile, the shape of which ensures the lift during the displacement of the device 1.

The foil 1 also comprises at least one pole 4. The latter extends vertically or substantially vertically. In particular, said pole 4 may extend in or parallel to the longitudinal vertical median plane of said foil 1. Such a pole 4 may include several different, grouped or separate legs, over the whole or part of its length. These legs may be straight or inclined, extending in said longitudinal vertical median plane of said foil 1. Said pole 4 may be of any shape, preferably of a shape having an aerodynamic or hydrodynamic profile. According to the preferred embodiment, the pole 4 has an elongated and flattened shape along its width, or tapered, with a segment globally tapered in cross-fuselage along a horizontal or substantially horizontal transverse plane.

This pole 4 is intended to cooperate in fastening in a removable way from the lower side of a watercraft, above a board for practicing water sports as defined previously. To this end, the pole 4 is provided in the upper portion with fastening means (not shown). These means ensure the holding and making integral of the foil 1 with the board, but also the transmission of the lift forces for lifting the board during the displacements of the foil assembly 1 fastened to the board into contact with and above the water.

Furthermore, the pole 4 is provided in the lower portion with a fuselage 5. The latter forms the fuselage of the foil 1. It extends along an axis in or parallel to the longitudinal vertical median plane of the foil 1, from the front to rear. It globally has an elongated spindle-shape with a preferably, but non-restrictively, circular or oval cross-fuselage.

In preferred embodiments of the invention, the pole 4 has a length between 600 mm and 1200 mm, preferably between 750 mm and 950 mm, preferably of 880 mm.

In other preferred embodiments, in order to provide a firmly fixed aerodynamic profile, on the one hand, to the fuselage 5 and, on the other hand, to the board, the width of the pole 4 is vertically changing, and varying between 70 mm and 200 mm, preferably between 80 mm and 150 mm, and preferably the width of the mast varies between 100 mm and 120 mm. In particular, the width of the pole 4 in the lower portion, at the level of its fastening to the fuselage 5, is of 100 mm.

In the same way and for the same reasons as the width of the pole 4, in yet other preferred embodiments, its thickness is also varying vertically, and varies between 9 mm and 25 mm, preferably between 12 mm and 20 mm and preferably the thickness of the pole 4 is changing between 12 mm and 14 mm. In particular, the thickness of the pole 4 in the lower portion, at its fastening to the fuselage 5, is 12 mm.

The fuselage 5 serves as a support for the wing, from which it extends. Preferably, each wing 2 and 3 extends laterally, projecting symmetrically on both sides, right and left with respect to the longitudinal vertical median plane of the fuselage 5.

Advantageously, the fuselage 5 is divided into several segments, at least two segments.

It should be noted that each wing 2 and 3 is integral with a segment of the fuselage 5. In other words, during the manufacture, the segment of the fuselage 5 supporting each wing portion 2 and 3 is formed of one and the same part.

In the first place, the fuselage 5 comprises a central segment 6 connected to the lower portion of the pole 4.

The pole 4 can be permanently or in a removable way connected to the fuselage 5 at the level of the central segment 6. In particular, the lower end of the pole 4 may be shaped and dimensioned so as to cooperate in a complementary way with the central segment 6 of the fuselage 5. This cooperation occurs namely by interlocking, the pole 4 forming a male portion that inserts into a female portion provided for within the central segment 6, or vice versa. A specific fastening can then ensure the holding by interlocking of these two parts.

According to some preferred embodiments of the invention, the length of the central segment 6, which extends longitudinally according to the fuselage 5 varies between 70 mm and 360 mm and preferably between 100 mm and 200 mm.

Advantageously, according to other preferred embodiments, the central segment 6 is not longer than twice the width of the pole 4. This feature permits to reduce the size and to avoid that, once it has been disassembled, the central segment 6 does not excessively exceed the width of the pole 4. Thus, the part has neither a T-shape nor an L-shape, which are shapes difficult to be stored or transported. As a result, the length of the central segment 6 is preferably between 150 mm and 190 mm, preferably 175 mm.

Preferably, according to yet other preferred embodiments, the cross-fuselage of the fuselage 5 has an oval-shaped cross-fuselage varying between 20×20 mm and 30×50 mm, preferably of 23×30 mm.

Other segments abut against the central segment 6, and are fastened in a removable way.

By abutting must be understand that the segments are joined end to end, i.e. connected to each other by a specific connection located at one of their end, the end of a segment connected to another segment is referred to as abutting end. In other words, the specific connecting area forms the only area of contact between the various segments that support the wing. In other words, the distal ends located in front of the segments are joined to each other.

In particular, the fuselage 5 comprises at least a removable first segment 7 integral with at least a first portion of the wing.

According to a first embodiment, the fuselage 5 comprises a single first removable segment 7 integral with at least a first portion of the wing. In this case, the fuselage 5 is divided into only two segments, for example the central segment 6 connected to the pole 4 and another segment abutting against the front or the rear of the central segment 6. Therefore, if the removable first segment 7 is at the front, it supports the front wing 2 and the rear wing 3 is integral with the central segment 6, which extends to the rear end of the foil 1. Conversely, if the removable first segment 7 is located at the rear, then the rear wing 3 is removable, while the front wing 2 is fixed, fastened to the central segment 6, which extends to the front end of the foil 1.

In order to obtain this removability of the central segment 6 and of the first segment 7 of the fuselage 5, the latter comprises means for assembling 8 at least one end of the central segment 6 with an abutting end of the first segment 7.

In a particular embodiment of the invention, the fuselage 5 merges into the lower portion of the pole 4, which is interlocked through the assembling means 8 to a wing 2.

In another particular embodiment of the invention, the fuselage 5 merges into the wing 2, which is interlocked to the lower portion of pole 4 by the assembling means 8.

The assembling means 8 ensure the connection of the segments 6 and 7 to each other at the level of their abutting end, as well as their holding. This holding results into the blocking in displacement of each removable segment when it is assembled to the central segment 6, outside the direction of interlocking permitting to assemble and disassemble the segments. This direction of interlocking extends along the longitudinal median axis of the fuselage 5. In other words, once they are assembled, the segments cannot move laterally or rotate with respect to each other, relative to the longitudinal median axis of the fuselage 5.

The assembling means 8 may be in the form of at least one pair comprised of a male connector 80 and a female connector 81 cooperating by interlocking. Each pair is provided for at the level of the abutting ends of the segments.

Figure 3:
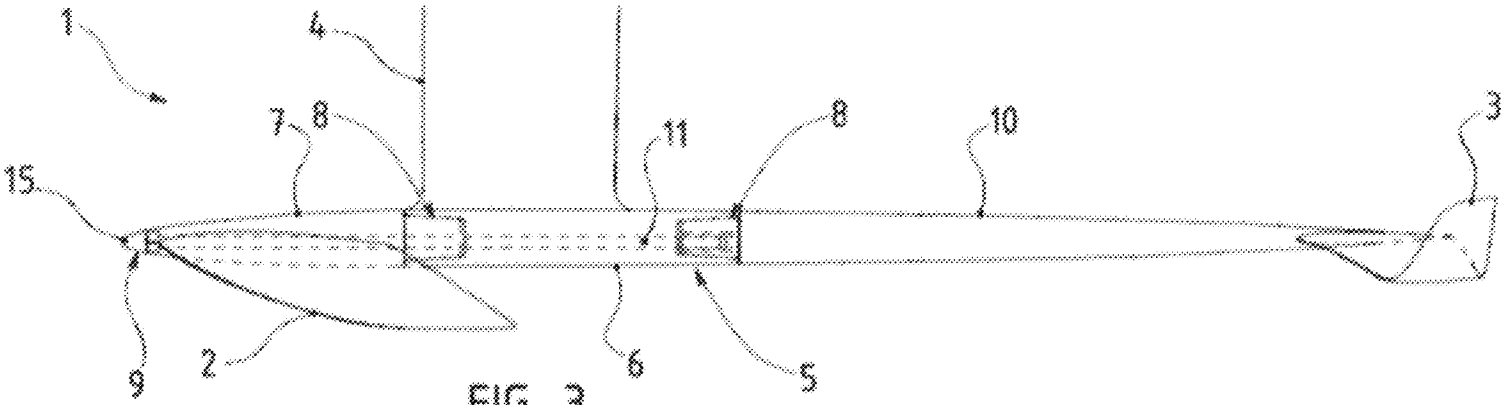
Figure 4:
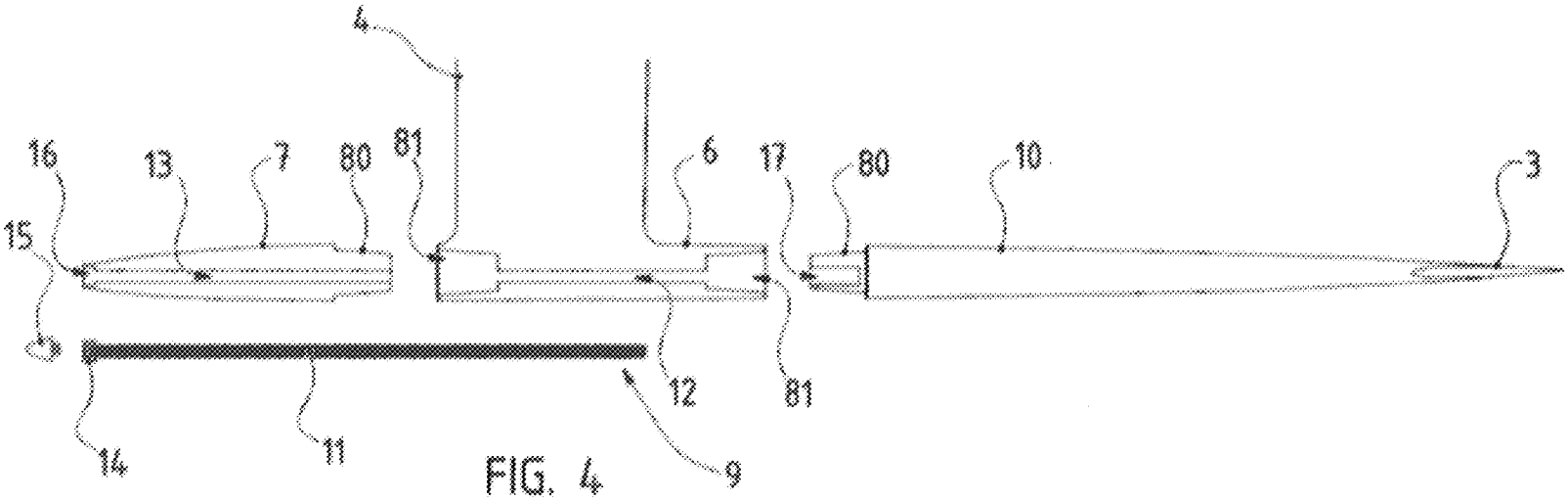
FIG. 4 is a side elevation view of a longitudinal median vertical cross-fuselage of said embodiment of the foil device, in disassembled position.

Furthermore, as illustrated in FIGS. 3 and 4, the connection through interlocking between the male connector 80 and the female connector 81 is the only area of contact between each abutting segment.

The specific connection between the male connector 80 and the female connector 81 participates in holding the assembling of the foil 1 against the multidirectional stresses exerted by the water during the displacements of the foil 1, except for the translational constraint along the longitudinal axis of the fuselage 5 the segments of which are held by the locking means 9.

Preferably, the male end 80 is provided for projecting at the end of removable segment, namely the first segment 7, while the recessed female connector 81 is provided for within the adjacent end of the central segment 6. The reverse is also possible.

The male 80 and female 81 connectors have complementary dimensions and shapes, to within the clearance, which permits their interlocking.

Figure 5:
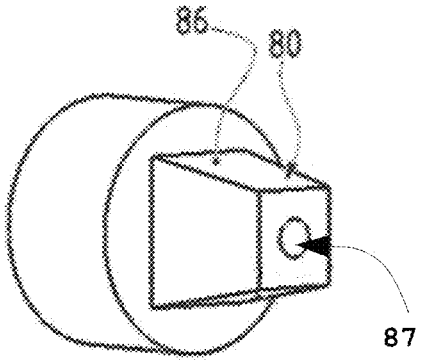
FIG. 5 is a perspective view of a detail of the foil according to a first embodiment, showing the male portion of one end of a segment.
Figure 6:
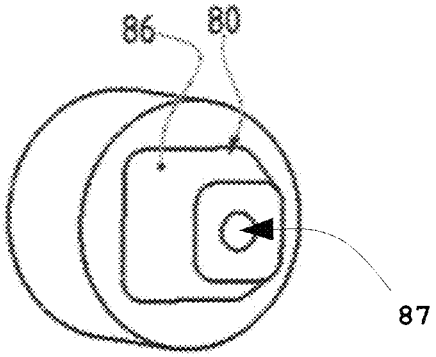
FIG. 6 is another perspective view similar to FIG. 5, according to another embodiment.

Several examples of shapes are shown in FIGS. 5 to 8. In particular, the male connector 80 may have a polyhedral shape, namely a truncated pyramidal shape with a triangular, rectangular, square or polygonal or even a star-like base. The polygon cross-fuselage, with edges, ensures the blocking, namely in rotation, of the segments with respect to each other. Two examples are schematically shown in FIGS. 5 and 6.

Preferably, the male connector 80 comprises at least one inclined wall intended to cooperate with a complementary inclined wall provided for at the level of the female connector 81.

According to a particular embodiment, the male connector 80 has at least one inclined outer wall 86, decreasing from the inside to the outside of the segment. This inclined outer wall 86 is intended to cooperate with an inner wall, which is also inclined, provided for within the female connector 81 of the abutting end, in a converging way from the outside to the inside of the adjacent segment.

Thus, during locking, the inclined walls slide against each other, ensuring an improved guiding, centering and positioning of the interlocking segments, once the abutting ends have been assembled. Moreover, during locking, the interlocking of these inclined walls ensures a perfect junction between the segments.

Figure 7:
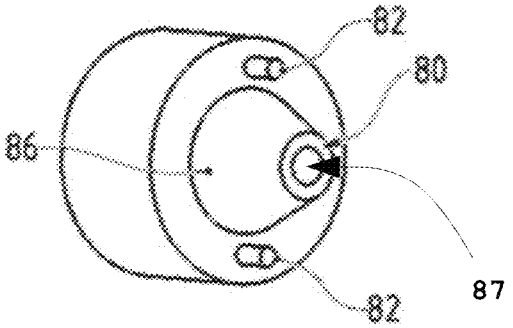
FIG. 7 is still another perspective view similar to FIG. 5, according to a different embodiment.

As can be seen in FIG. 7, the male connector 80 can have a frustoconical shape and the inclined outer wall 86 is formed by the outer wall. The female connector 81 then comprises a inversed truncated cone, of complementary dimensions, the peripheral inner wall of which then form the inclined inner wall.

Additionally, but non-restrictively, the blocking in rotation can then occur by at least one pin 82—preferably two—provided for projecting offset, at the end of the male connector 80 or at least on one side, and co-operating within a hole or blind hole provided for in front, within or on one side of the female connector 81.

According to a preferred embodiment represented in FIG. 5, the male connector 80 has a truncated pyramidal shape, with a rectangular base. The outer faces of the truncated pyramid then each form an inclined outer wall 86, preferably, the outer walls 86 are inclined at an angle of at least 2° and preferably 3° with respect to a vertical projection of a plane defined by a base line of an outer face of the truncated pyramid.

In a preferred embodiment, the cross-fuselage of the rectangular base of the truncated pyramid has dimensions varying between 12×12 mm and 25×40 mm, preferably between 15×15 mm and 25×30 mm, preferably of 18×19 mm. As a result, the connection area between each segment of the fuselage 5 varies between 114 mm2 and 1000 mm2, preferably between 225 mm2 and 750 mm2, and is preferably of 340 mm2. In addition, the preferred height of the truncated pyramid varies between 30 mm and 100 mm, preferably between 40 mm and 60 mm, and is preferably of 50 mm.

According to the embodiment represented in FIG. 6, the edges of the truncated pyramid of the previous embodiment are rounded. These edges with the outer faces then form together the inclined outer walls 86.

These embodiments require a fuselage 5 the interior of which is solid, in order to provide in same the female connector 81, or receiving an additional part, such as a cover, on which the male 80 and female connectors 81 are provided for.

Figure 8:
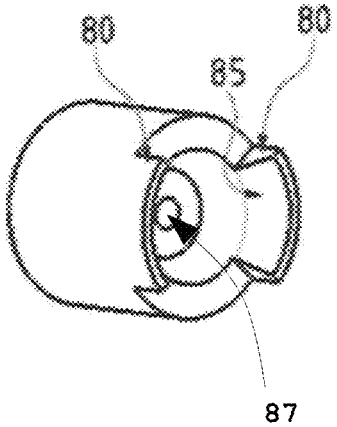
FIG. 8 is yet another perspective view similar to FIG. 5, according to another different embodiment.

According to yet another embodiment, as can be seen in FIG. 8, the male connector 80 may be formed on a hollow or tubular body of the fuselage 5. Therefore, it is in the form of arcs extending projecting on part of the perimeter of the end of a segment. The female connector 81 is then formed of complementary notches.

Moreover, in order to improve the blocking in interlocking during the locking and the right positioning of the segments with respect to each other, each arc 85 may have an inner wall inclined, according to a frustoconical curvature, intended to cooperate against a complementary outer wall provided for at the level of the corresponding female connector 81.

Thus, the inclination of the inner 86 and outer walls of the male 80 and female 81 connectors provides a perfect assembling, without clearance, once the segments are locked.

In this regard, an essential feature of the present invention resides in the locking of the assembly of the segments of the fuselage 5. This locking through interlocking of the assembled segments occurs according to a component oriented along the longitudinal axis of the fuselage 5. In other words, the locking does not occur transversely or orthogonally, but longitudinally with respect to the fuselage 5.

To this end, the foil device 1 comprises means 9 for locking the first segment 7, with at least the central segment 6. In addition, the locking means 9 extend along the longitudinal axis of the fuselage 5 and ensure the locking in at least one direction of the longitudinal axis of the fuselage 5.

In other words, the locking means 9 cooperate with each segment, in order to block their interlocking. Moreover, the inclined wall of male connector 80 and female connector 81 cooperates with locking means and contributes in centering, tightening, blocking and locking the fuselage 5 segments so that eliminate all slack between each fuselage 5 segment. These means 9 have a component substantially orthogonal to the median axis of the pole 4, namely their horizontal or substantially horizontal component (along the longitudinal median axis of the fuselage 5) is greater than the vertical or substantially vertical component (along the longitudinal median axis of said pole 4).

Preferably, the locking means 9 have a single horizontal or substantially horizontal component.

The fuselage 5 can be divided into three segments. According to a specific embodiment, not shown, an intermediate segment may be intercalated between the central segment 6 and the first segment 7. In other words, the first segment 7 is divided into two.

It is also possible to subdivide each segment into other additional sub-segments, without limitation of their number.

Thus, depending on the level or the weather conditions, it is possible to adapt the length of the fuselage 5 and the fuselage of the foil 1 by removing or adding a segment, or by exchanging segments of different lengths.

Generally, the fuselage 5 comprises at least a removable second segment 10 integral with at least a second portion of the wing.

Figure 2:
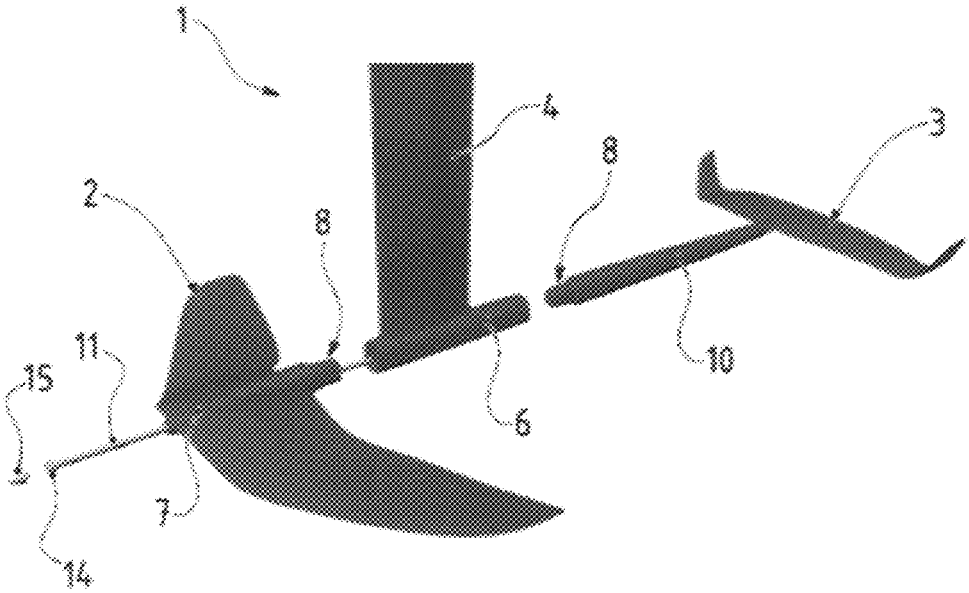
FIG. 2 represents an exploded perspective view of FIG. 1 showing this embodiment of a foil according to the invention in disassembled position.

According to a preferred embodiment, visible in FIGS. 1 to 3, the fuselage 5 comprises three segments. These three segments are the front 7, central 6 and rear 10 segments. The second segment 10 may receive the rear wing 3, while the first segment 7 receives the front wing 2, as can be seen in FIGS. 1 to 3 (or vice versa).

The abutment of the central segment 6 and the second segment 10 also occurs by assembling means. The latter are similar to the previously described means.

In this configuration, the abutting ends of the first 6 and second 10 segments include their respective male connector 80, while the first end and the opposite second end of the central segment 6 include the corresponding female connectors 81. The reverse is also possible, i.e. the central segment 6 has the male connectors 80 at each end, while the segments 7 and 10 have the female connectors 81 at one of their ends intended to be abutted against the central segment 6.

These similar assembling means and the locking means 9 mutually ensure the assembling and the locking of an opposite second end of the central segment 6 with an abutting end of the second segment 10.

In other words, the locking means 9 permit to fasten together two segments. This locking always occurs according to the longitudinal median axis of the fuselage 5.

According to the general embodiment with a minimum of two segments, the locking means 9 comprise at least one rod 11 extending at least partially along at least the first segment 7 and cooperating in locking with the central segment 6.

In other words, the rod 11 passes through the assembled ends of the abutting segments, in order to apply a clamping force in the longitudinal direction of interlocking.

As illustrated in FIGS. 5 to 8, a slot 87 with a diameter slightly larger than that of the rod 11 is provided for at the center of each male 80 and female 81 connector, permitting the rod 11 to pass through each abutting segment.

According to a preferred embodiment of the invention, the rod has a length varying between 50 mm and 400 mm, preferably between 100 mm and 350 mm, preferably of 295 mm. In addition, the diameter of the rod varies between 5 mm and 10 mm, and is preferably of 6 mm.

According to the embodiment with three front 7, central 6 and rear 10 segments, this locking passes through the central segment 6 in its entirety, from one end to the opposite end.

To this end, the locking means 9 comprise at least one rod 11 extending from the first segment 7 in order to completely traverse the central segment 6, through a central recess 12, and to insert into the second segment 10. This configuration may include two rods 11, which are accommodated at the level of each end, on both sides in the central segment 6, through one or more central recesses 12, and at the level of the opposite end in recesses specific for each front 7 and rear 10 segment.

As mentioned above, this rod 11 may extend from the front segment 7 to the rear segment 10, or vice versa.

In addition, each rod 11 comprises at least one outer end thread, so as to cooperate with a complementary inner thread provided for within the abutting end of the central segment 6 or of the second segment 10.

According to another embodiment, the locking means 9 comprise at least one rod 11 cooperating in insertion within a first recess 13 provided for along the first segment 7 from an opposite free end to the abutting end. In addition, the rod 11 cooperates in locking at least through the first end of the central segment 6 with another one of the segments of the fuselage 5, such as the second segment 10. In this configuration, the rod 11 is inserted into and locked in the first recess 13 in the form of a blind hole. It protrudes from the hole in order to pass through the central segment inside and along its central recess 12, in order to emerge at the opposite end and be locked inside the second segment 10.

More specifically, according to the preferred embodiment, visible in FIGS. 2 to 4, the locking means 9 comprise one single rod 11 cooperating in insertion within a first recess 13 provided for along the first segment 7, from an opposite free end to the abutting end and within a central recess 12 provided for along the central segment 6, from its first end to its second end, the rod 11 cooperating in locking within the abutting end of said second segment 10. In this configuration, the first recess 13 is a through-recess and the rod 11 is slidably inserted from one end of the first segment 7, in order to pass completely through it, exiting and passing completely through the central segment 6, in order to end at and insert in locking into the second segment 10. It is thus possible to lock and unlock the rod 11 by its free end from the distal end of the first segment 7.

In this case, the rod 11 has a distal end cooperating in abutment against the opposite free end of the first segment 7. To this end, the first recess 13 may include, at its free end, an annular setback 16 intended to receive the distal end of the rod 11 at the level of which an annular ring 14 is formed. The latter then cooperates in interlocking within the setback 16, limiting its travel distance along and within the segments, which it passes through.

In particular, the distal end may include a removable end ferrule 15. The latter can be fastened by screwing onto the annular ring 14, which then has internally a complementary inner thread.

Furthermore, at the level of its opposite end, the rod 11 may have an outer thread, intended to cooperate with a complementary inner thread provided for within the most distant segment, namely the central segment 6 in the case of only two fixed segments fastened together, or the second segment 10 in the case of three abutting segments.

In addition, it should be noted that the rod 11 can pass through the male 80 and female 81 connectors, as illustrated in FIGS. 5 to 8. The longitudinal recesses of each segment then pass through the corresponding male 80 and female 81 connectors.

Furthermore, the various elements forming the foil 1, namely the pole 4 and the segments of the fuselage 5, may be made of any kind of material, preferably of carbon fiber. The rod 11 and its ferrule 15 may be made of metal, preferably of stainless steel. In addition, metallic or composite inserts may be inserted into the segments, in their recess, in order to cooperate by screwing with the rod 11.

Thus, according to the embodiment visible in FIGS. 1 and 2, during the mounting of the foil 1, the first segment 7 located at the front and the second segment 10 located at the rear are abutted and assembled by interlocking their male connector 80 with the female connectors 81 of the central segment 6. Then, the stem 11 is inserted from the front end, i.e. the distal end of the first segment 7, in order to cause it to slide along the so assembled fuselage 5, until it cooperates within the recess 17 of the second segment 10 located at the rear. The rod 11 is screwed, by tightening the segments 6, 7 and 10 and locking their assembling through interlocking. Finally, the ferrule 16 is screwed onto the front end of the rod 11.

The disassembling of such a foil 1 occurs by repeating the above steps inversely.

The foil device 1 according to the invention thus permits to quickly and simply assemble the segments so as to form the fuselage 5, without any adjustment or assembling error. In addition, the longitudinal locking ensures an improved blocking of the segments with respect to each other, limiting the wear of the fastening and interlocking parts. The holding in longitudinal locking provides a better distribution of the torques applied during the use of the foil 1, providing a better resistance to the mechanical stresses exerted on it and increasing its lifetime. In addition, no fastening part passes laterally or radially through the walls of the fuselage 5, which provides a refined, more aerodynamic or hydrodynamic line. Finally, the inclination of the interlocking parts ensures a perfect junction between the segments.

Thus, the inclination of the inner and outer wall of the male 80 and female 81 connectors for the assembling and interlocking, combined with a longitudinal locking ensures a better connection between the segments, thus improving the rigidity, the strength and the accuracy of the foil 1 according to the invention.

I claim:

1. Foil comprising:

a wing, having a first portion and a second portion; and a fuselage extending in a longitudinal direction and bearing said wing, said fuselage comprising:

a central segment;

a first segment bearing said first portion of said wing and being removable from said central segment; and assembling means for said central segment and said first segment in said longitudinal direction, wherein said central segment and said first segment are connected end to end by the assembling means, said assembling means comprising a pair formed by a male connector and a female connector cooperating through a specific interlocking, male and female connectors being located at a central segment extremity and at a first segment extremity, wherein said male connector comprises at least one outer inclined wall, being complementary and cooperating with an internal inclined wall born by said female connector, said outer inclined wall of said male connector and said internal inclined wall of said female connector providing an interlocking between said central segment and said first segment, further comprising:

locking means, extending along said longitudinal axis of said fuselage and cooperating with said male connector and said female connector the male and female connectors being locked in at least one direction of said longitudinal axis.

2. Foil according to claim 1, wherein contact between the central segment and the first segment consists of contact between the male connector and the female connector.

3. Foil according to claim 1, wherein said fuselage further comprises a second segment bearing a said second portion of said wing, said second segment being removable from said central segment, said assembling means connecting said central segment and said second segment in said longitudinal direction, wherein said central segment and said second segment are connected end to end by the assembling means, said assembling means comprising an additional pair formed by an additional male connector and an additional female connector cooperating through a specific interlocking, the additional male and female connectors being located at a central segment extremity and at a second segment extremity, wherein said additional male connector comprises at least one outer inclined wall, being complementary and cooperating with an internal inclined wall born by said additional female connector, said outer inclined wall of said additional male connector and said internal inclined wall of said additional female connector providing an interlocking between said central segment and said second segment, further comprising:

an additional locking means, extending along said longitudinal axis of said fuselage, the additional male connector and the additional female connector being locked in at least one direction of said longitudinal axis.

4. Foil according to claim 3, wherein contact between the central segment and the second segment consists of contact between the male connector and the female connector.

5. Foil according to claim 3, wherein the connected extremity of the first segment and the connected extremity of the second segment include their respective male connector, while the first extremity and the opposite second extremity of the central segment include the corresponding female connectors.

6. Foil according to claim 1, wherein the locking means comprise a rod extending at least partially along at least the first segment and cooperating in locking with the central segment.

7. Foil according to claim 6, wherein said rod inserts within a first recess provided for along the first segment from a free extremity of the first segment opposite its connecting extremity and to said connecting extremity of the first segment, the rod cooperating in locking at least through the first extremity of the central segment with another one of the segments of the fuselage.

8. Foil according to claim 3, wherein the locking means comprise a rod extending at least partially along at least the first segment and cooperating in locking with the central segment, wherein said rod inserts within a first recess provided for along the first segment from a free extremity of the first segment opposite its connecting extremity and to said connecting extremity of the first segment, the rod cooperating in locking at least through the first extremity of the central segment with another one of the segments of the fuselage, and wherein said rod inserts within a first recess provided for along the first segment from its free extremity opposite its connecting extremity and within a central recess provided for along the central segment from its first extremity to its second extremity, the rod cooperating in locking within the connecting extremity of the second segment.

9. Foil according to claim 8, wherein said rod has a distal extremity cooperating in abutment against the opposite free extremity of the first segment.

10. Foil according to claim 9, wherein said rod comprises at least one outer extremity thread so as to cooperate with a complementary inner thread provided for in the connecting extremity of the central segment or the second segment.

11. Foil according to claim 9, wherein each male connector and female connector has a center with a slot with a diameter slightly larger than that of the rod, permitting the rod to pass through each connecting segment.

12. Foil according to claim 1, wherein the male connector comprises two inclined walls complementary and cooperative with two inclined walls provided for at the female connector.

13. Foil according to claim 1, wherein the male connector comprises four inclined walls complementary cooperative with four inclined walls provided for at the female connector.

* * * * *